US007261764B1

(12) United States Patent
Pletcher

(10) Patent No.: US 7,261,764 B1
(45) Date of Patent: Aug. 28, 2007

(54) SYSTEM AND METHOD FOR SPATIALLY-SELECTIVE PARTICULATE DEPOSITION AND ENHANCED DEPOSITION EFFICIENCY

(75) Inventor: Timothy Allen Pletcher, Eastampton, NJ (US)

(73) Assignee: Sarnoff Corporation, Princeton, NJ (US)

( * ) Notice: Subject to any disclaimer, the term of this patent is extended or adjusted under 35 U.S.C. 154(b) by 0 days.

(21) Appl. No.: 11/405,787

(22) Filed: Apr. 18, 2006

Related U.S. Application Data

(60) Provisional application No. 60/673,013, filed on Apr. 19, 2005, provisional application No. 60/672,821, filed on Apr. 19, 2005.

(51) Int. Cl.
*B03C 3/36* (2006.01)

(52) U.S. Cl. ..... 95/58; 96/44; 96/63; 96/83; 96/88; 96/95; 118/621; 361/226

(58) Field of Classification Search ..... 96/63, 96/44, 95, 98, 83, 84, 88; 95/58; 361/225–235; 118/621
See application file for complete search history.

(56) References Cited

U.S. PATENT DOCUMENTS

| | | | | |
|---|---|---|---|---|
| 977,335 | A * | 11/1910 | Shaffner | 96/63 |
| 2,949,167 | A * | 8/1960 | Bergstedt | 96/88 |
| 5,084,078 | A * | 1/1992 | Suzuki et al. | 96/52 |
| 5,797,978 | A * | 8/1998 | Rosenberg et al. | 95/74 |
| 6,221,136 | B1 * | 4/2001 | Liu et al. | 96/66 |
| 6,391,097 | B1 * | 5/2002 | Rosenberg | 96/87 |
| 6,989,050 | B2 * | 1/2006 | Ganeev et al. | 96/63 |
| 7,101,424 | B2 * | 9/2006 | Wascher et al. | 96/88 |
| 7,115,153 | B2 * | 10/2006 | Ahlborn et al. | 95/74 |
| 2004/0065203 | A1 * | 4/2004 | Rosenberg | 96/69 |
| 2004/0069047 | A1 * | 4/2004 | Coyle et al. | 73/28.04 |
| 2006/0249025 | A1 * | 11/2006 | Clark et al. | 96/44 |
| 2007/0068387 | A1 * | 3/2007 | Pletcher et al. | 96/83 |

* cited by examiner

*Primary Examiner*—Richard L. Chiesa
(74) *Attorney, Agent, or Firm*—Lowenstein Sandler PC

(57) ABSTRACT

The present invention relates to a methods, apparatuses and systems that utilize electric currents to direct the deposition of particulate matter to various surfaces.

20 Claims, 2 Drawing Sheets

SYSTEM AND METHOD FOR SPATIALLY-SELECTIVE PARTICULATE DEPOSITION AND ENHANCED DEPOSITION EFFICIENCY

CROSS-REFERENCE TO RELATED APPLICATIONS

This application claims the benefit of U.S. Provisional Patent Application Nos. 60/672,821 and 60/673,013, both filed Apr. 19, 2005, the entire disclosures of which are hereby incorporated herein by reference.

GOVERNMENT RIGHTS IN THIS INVENTION

This invention was made with U.S. government support under contract number W911SR-04-C-0025. The U.S. government has certain rights in this invention.

FIELD OF THE INVENTION

The present invention relates to methods, apparatuses and systems that utilize electric currents to direct the deposition of particulate matter to various surfaces.

BACKGROUND OF THE INVENTION

A number of industrial and military processes require particulate to be removed from an aerosol apparatus and deposited onto a surface. Two examples are electrostatic powder painting and particle concentrators, which are components of chemical and biological detection systems. The importance of electrostatics for this purpose is well known to those of skill in the art.

The use of electrostatics-based systems as a means of removing particulate from an aerosol has been known for over seventy years. The first practical use of electrostatics-based systems for this purpose was the electrostatic precipitator used to clean the exhaust systems in various industrial settings, including power generating plants, chemical processing plants and pharmaceutical plants. These early electrostatic precipitators, still used to achieve the particulate removal, are characterized by very simple construction and operating principles. Most consist of a wire concentrically positioned at the center of a cylindrical duct and a high voltage applied to a central conductor sufficient to produce a corona current between the wire and the duct wall. The corona produces a unipolar charge density between the wire and the duct walls. Particulate entering the corona field charges according to the field charging equations described by Pauthenier, which are well-known to those of skill in the art, and is then forced to the duct wall by the electric field applied between the wire and the duct wall.

Thirty years after the commercial development of the electrostatic precipitator, a second commercial application of electrostatics was developed: electrostatic particulate deposition. This time the application was in the area of industrial powder painting. The primary industrial advantage of applying paint coatings as a powder is the removal of solvents from the painting process. These industrial powder coating systems operate in a manner very similar to that described for electrostatic precipitators.

The main difference between the two systems is the manner in which the corona ion current is developed and used. The powder coating systems use one or more electrodes placed at the output of an insulating tube through which powder and air are conveyed. The electrode or electrodes are electrically biased to a voltage sufficient to create a corona current between the electrodes and a grounded deposition surface. The ion flux flowing between the electrodes and the deposition surface charge the particles leaving the tube. The charged particulate is then conveyed to the deposition surface by the forces applied from both the electric field and the aerodynamic drag generated by the conveying air. Deposited particles adhere to the deposition surface due to electrostatic forces formed between the particulate matter and the grounded surface as well as to Van der Waals forces.

A disadvantage of the industrial systems described above is that the charge density and the electric field within the particulate charging zone are non-uniform. It is well documented that current corona wire charging systems produce spatially varying corona current density and electric field along their axial dimension. This effect causes these systems to be much larger than is necessary to meet the requirements for particulate removal. This geometry also forces the deposition of the particulate onto the cylindrical duct surface. For systems needing focused, efficient particulate concentration, this geometry is particularly unattractive.

One example from the prior art that demonstrates this problem is the electrostatic spray gun used for powder coating. This device uses single or multiple electrodes arranged at the output of a cylindrical tube having a diameter of about ⅝". The target deposition surface is usually 12-24" from the point or points of the corona ion current generation that occurs at the corona electrode. In this configuration, the corona ion current, whether generated from a single point or from multiple points, behaves very much like a point-to-plane corona ion current where the ion current is known to decay rapidly when measured at angles varying from normal to the deposition surface. Powder particle trajectories leaving the tube often fall outside the charging zone produced by this corona configuration. This results in a lowering of the transfer efficiency for the coating system.

In summary, there remains a need for more predictable and efficient corona particulate charging and deposition systems, especially for systems designed to focus and concentrate the particulate depositions. In the embodiments of the present invention, methods for more efficient corona particulate charging and deposition systems are shown. Likewise, it is important to develop a corona particulate charging system that dispenses with the need for a corona wire component. Hence, further advantages of embodiments of the present invention include the elimination of the need to accommodate cumbersome corona wire charging systems by eliminating the need for the corona wire component.

Embodiments of the present invention provide improved particulate deposition efficiency, spatial uniformity of depositions, and spatially-selective controlled depositions for the various particle transport systems. Embodiments of the present invention also provide new applications by the novel configuration and control of corona electrode arrays.

SUMMARY OF THE INVENTION

Embodiments of the present invention include a method of achieving uniform particulate depositions onto surfaces including the steps of providing one or more units of particulate matter; providing a deposition surface capable of (1) conducting an ion current; and (2) drawing said units of particulate matter to said deposition surface; providing a tube; providing an array of one or more corona electrodes capable of (1) creating an corona ion current; (2) creating a particulate charging zone having an ion charge density in the range of 0.001-0.01 Coulombs/meter$^3$; (3) charging greater than or equal to 99.5% of all units of particulate matter passing through the charging zone; (4) charging each unit of the 99.5% of all units of particulate matter to its saturation level in 500 microseconds or less; (5) producing a spatially uniform charge density that reduces the negative effects of any corona wind generated; providing one or more resistors associated with the corona electrodes and capable of being selectively set to one or more possible settings; spatially configuring the array of corona electrodes about the deposition surface such that a uniform electric field is generated; affixing the corona electrodes to the tube; providing a means for creating an aerodynamic force; applying the electric field and the aerodynamic force to the units of particulate matter; and focusing the particulate matter onto the deposition surface.

The present invention also describes apparatuses useful in the methods described herein.

BRIEF DESCRIPTION OF THE DRAWINGS

The present invention will be more readily understood from the detailed description of exemplary embodiments presented below, considered in conjunction with the attached drawings, of which

It is to be understood that the attached drawings are for purposes of illustrating the concepts of the invention and are not intended to limit the scope of the invention.

DETAILED DESCRIPTION OF THE INVENTION

Figure 1:
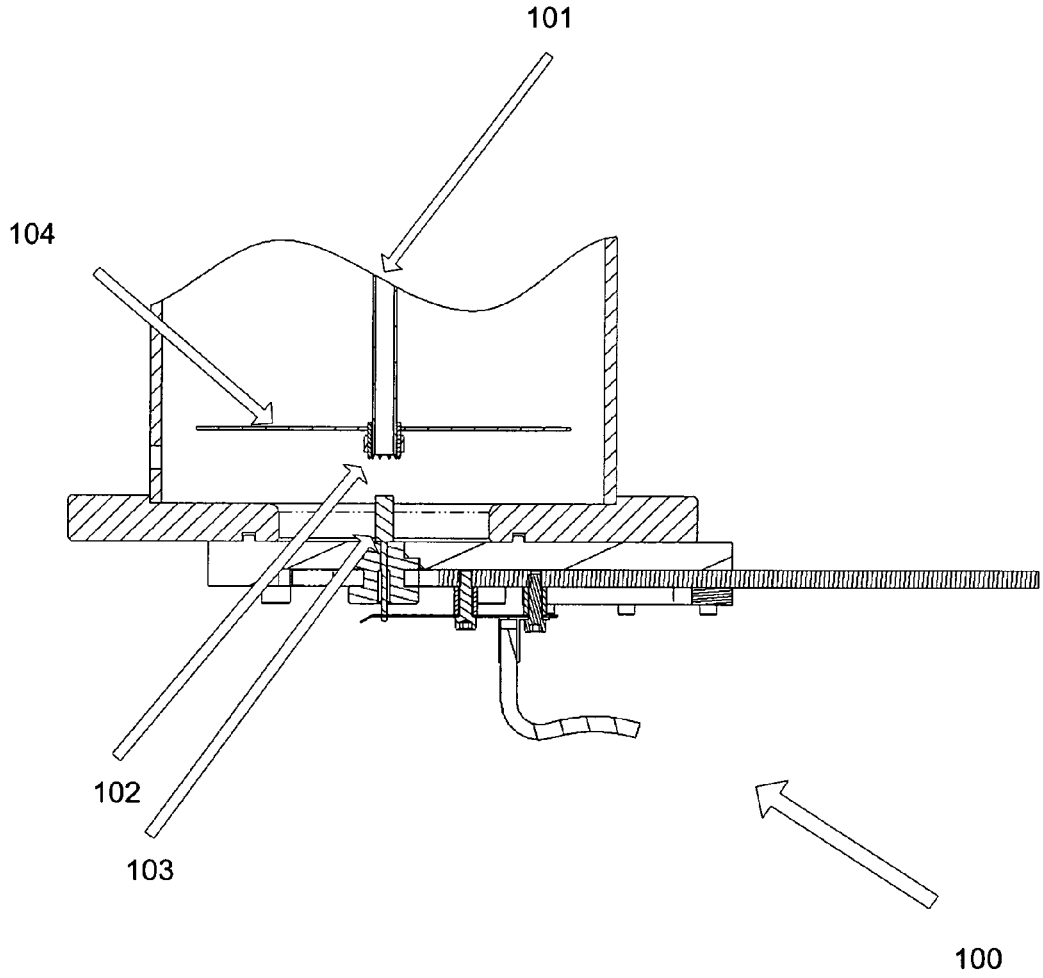
FIG. 1 is a cross-sectional view of a particle sorter embodiment of the present invention.

With reference to FIG. 1, embodiments of the present invention provide an electrostatic deposition system (100) having a particulate matter feed (such as a tube or other feed device) (101) for delivering a stream of particulate matter to be charged. The device also includes one or more corona electrodes (102) positioned and adapted to facilitate the flow of a corona ion current from the corona electrodes and intersecting the particulate matter stream. Embodiments of the present invention include one or more ballast resistors (104) associated with the corona electrodes. The term "particulate matter" as it is used herein refers to, but is not limited to any physical material such as a powder, capable of being electrically charged. The term "corona ion current" as it is used herein, refers to, but is not limited to an electrical discharge brought on by the ionization of a fluid surrounding a conductor, which occurs when the potential gradient exceeds a certain value. The term "corona electrode" as it is used herein, refers to, but is not limited to, a needle projection element in a system that emits a corona ion current into the system.

Embodiments of the present invention also include a deposition surface (103), adapted to be charged or grounded; to induce the corona flow from the corona electrode projections. The term "deposition surface" as it is used herein refers to an electrode having an electrical bias for attracting free ions, but does not imply that the electrode must be biased or coupled to ground potential. Indeed, the ground electrode can be charged or grounded and essentially provides a surface to capture free ions.

In another aspect of the embodiments of the present invention, the device includes two or more corona electrodes arranged in a uniform geometry so as to effect a uniform charge density.

Figure 2:
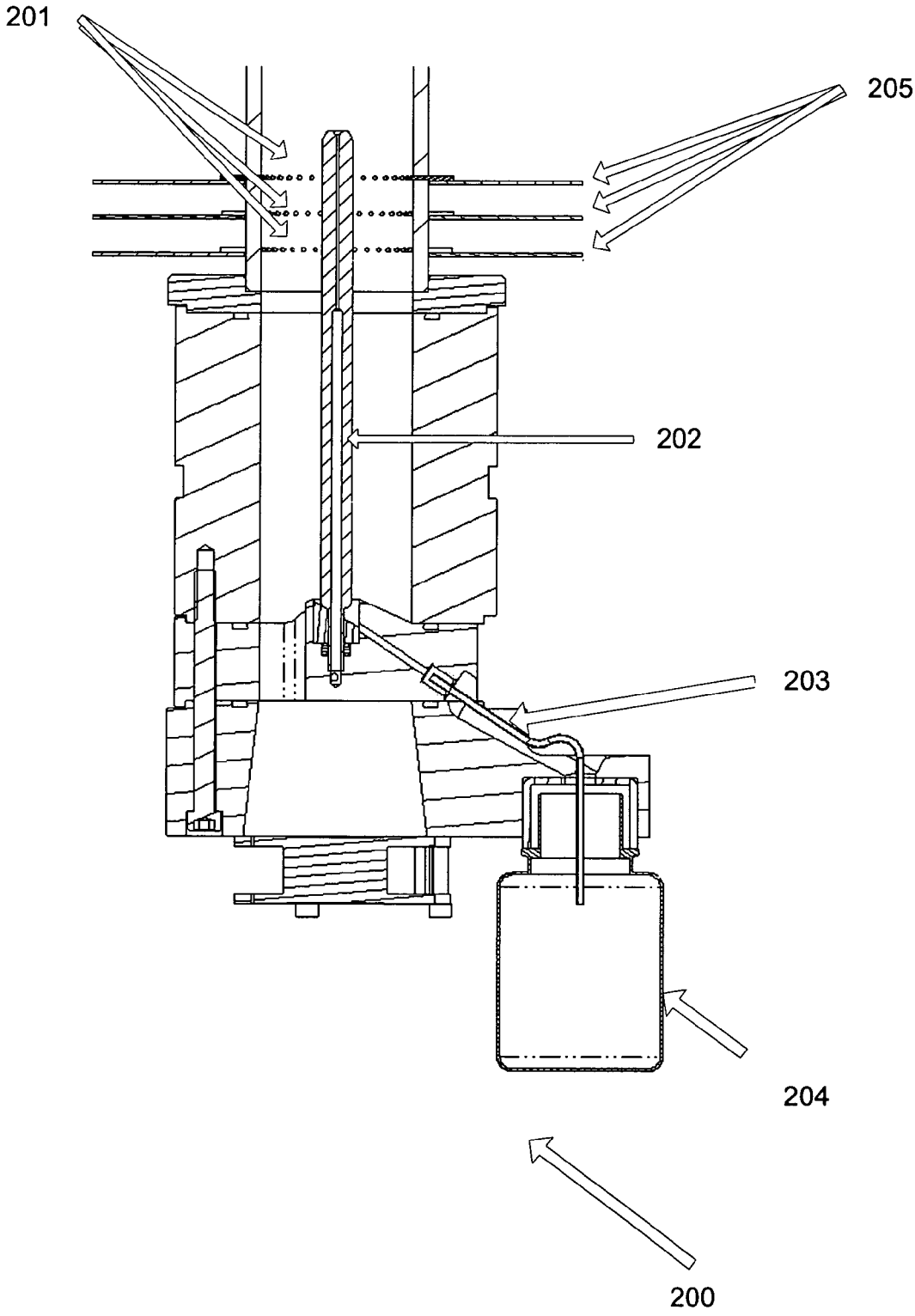
FIG. 2 is a cross-sectional view of a radial collector embodiment of the present invention.

With reference to FIG. 2, embodiments of the present invention provide a radial collector (200), that includes an array of corona electrodes (201) geometrically arranged so as to produce a uniform electric field. The embodiment further comprises a deposition electrode positioned as a rod (202) running through the midst of the corona array. Further, embodiments of the present invention include a stream of water or other liquid (not shown) that runs along the deposition electrode and collects the particles that have been deposited onto the electrode. The particles are carried along the liquid stream through a drain (203) to a fluid collection bottle (204) from which the particle-liquid composition may be transported to a detection system (not shown) to be analyzed, for example, for the presence of biohazards.

In another aspect of the invention, the device includes one or more power supplies (not shown) operable to produce voltage and current in the charging zone; at least one feedback control circuit (not shown) monitoring the ground electrode to maintain a precise current to the one or more corona electrodes by varying the power supply voltage; and an individual ballast resistor (205) associated with each corona electrode (201) so that the electrodes will produce a uniform corona ion flow. The association of a ballast resistor with each corona electrode allows the freedom to achieve a uniform electric field without necessarily arranging the corona electrodes in a strictly uniform geometry. Thus, the embodiments of the present invention allow for a wide variety of corona array geometries. The term "ballast resistor" as it is used herein, refers to, but is not limited to, a resistor incorporated into a system to compensate for changes including, but not limited to, those arising from temperature fluctuations.

In one embodiment of the invention, the number of ballast resistors equals the number of corona electrodes. In another embodiment of the invention, the number of ballast resistors differs from the number of corona electrodes.

Another aspect of the invention is directed to a method of corona charging a flow of particulate matter including the steps of forming a corona field between the tips of a geometrically uniform array of corona electrode projections and a ground electrode; and passing the particulate matter through the corona field to charge the particulate matter.

EXAMPLES

The use of corona electrode arrays has been demonstrated for a variety of deposition systems in the laboratory. The systems include a particle sorting system, an electrostatic powder coating system, and a radial collector that removes particles from the sampled air and deposits the particles into a water flow.

The primary difference between more traditional methods of electrostatic particulate deposition and that using of corona electrode arrays is the number of electrodes and their geometric orientation of corona generation with respect to the deposition surface or surfaces. With respect to the present invention, the main advantage of using multiple points of corona generation is derived from the spatial uniformity of the discharge that can be obtained. Better spatial uniformity of the ion generation has a number of key benefits, including uniform deposition of particulate matter onto a surface.

The following examples of embodiments of the present invention provide improvements in coating efficiency for coating a planar geometric surface by using a geometrically advantageous array of corona electrodes. In each of these examples, an array of corona electrodes is arranged at the periphery of an aerodynamic diffuser through which air and powder are conveyed. The aerodynamic force is generated by an aerodynamic fan or an aerodynamic blower or an aerodynamic pump.

Two configurations or electrode arrays were constructed and tested in the laboratory. One electrode array was configured using eight electrodes. A second configuration contained seventy-six electrodes. Very high efficiencies (i.e. charging of greater than or equal to 99.5% of all units of particulate matter passing through the charging zone) were achieved using the eight-electrode configuration. It was also shown that the spatial distribution of the resulting coating could be modified by varying the current density and electric field produced by the electrode array. A good application of this embodiment would be its application to the coil coating segment of the powder coating market. Coil coating is a high speed process of depositing particulate matter onto a flat sheet and is typically used to produce aluminum siding and some automotive components.

Another example of the use of a corona array to achieve particulate focusing is a system designed to control the landing zone for particulate conveyed from a tube. The corona array is arranged symmetrically at the periphery of the tube outlet. A local electric field is modulated at the deposition surface and monitored for corona current. It has been shown that the corona current can be switched between either electrode at the deposition plane. It has also been shown that the particle deposition onto these electrodes can be made to switch like the corona current. This effect is believed to be due to the control of both the electrostatic effects and the corona wind. The term "corona wind" as it is used herein refers to, but is not limited to, a fluid motion that results from the interaction of an electric field with a source of charged particles.

The advantage of using a corona array in this configuration is the symmetry of corona ion current generation. This has been shown experimentally. An alternative corona configuration was used and relied upon uniform corona generation at the edge of the tube. It was noted that particle deposition between electrodes proved to be inconsistent. The cause of the inconsistency was due to spatial variation of the generation of the corona ion current. Arranging a geometrically advantageous array of corona electrodes removed this problem.

The embodiments of the present invention are especially useful for controlling ion current uniformity and density. The corona electrode arrays described by the examples presented herein operate best when the spacing between the deposition electrode or electrodes and the corona array electrodes can be fixed. In each of the examples given, this was the case. The method used to control the ion current derived from each electrode is a combination of maintaining mechanical tolerances between the relative distances from each electrode tip to the deposition electrode and by adding a series ballast resistor between the high voltage connection and each electrode. The ballast resistor value is selected based upon the ion current uniformity desired, power dissipation within the ballast resistor, and the current limit selected to prevent transition from the corona generation region of operation to the arc-over region of operation. The ballast resistor has a resistance of at least 100 mega-ohms but less than 2 giga-ohms. The ballast resistor has a breakdown voltage of at least 10 kilo-volts, but less than 30 kilo-volts.

The ballast resistor can also be used to create a varying current density at each corona electrode. This can be advantageous if zones of different charge density are required or electrode spacing between the deposition electrode and each of the corona array electrodes is desired.

What is claimed:

1. A method of achieving uniform particulate depositions onto surfaces, comprising:

providing one or more units of particulate matter;

providing a deposition surface capable of (1) conducting an ion current; and (2) drawing said units of particulate matter to said deposition surface;

providing a tube;

providing an array of one or more corona electrodes capable of (1) creating an corona ion current; (2) creating a particulate charging zone having an ion charge density in the range of 0.001-0.01 Coulombs/meter$^3$; (3) charging greater than or equal to 99.5% of all units of particulate matter passing through said charging zone; (4) charging each unit of said 99.5% of all units of particulate matter to its saturation level in 500 microseconds or less; and (5) producing a spatially uniform charge density that reduces the negative effects of any corona wind generated;

providing one or more resistors associated with said corona electrodes and capable of being selectively set to one or more possible settings;

spatially configuring said array of corona electrodes about said deposition surface such that a uniform electric field is generated;

affixing said corona electrodes to said tube;

providing a means for creating an aerodynamic force;

applying said electric field and said aerodynamic force to said units of particulate matter; and focusing said units of particulate matter onto said deposition surface.

2. The method of claim 1, wherein the distances between the corona electrodes is uniform.

3. The method of claim 1, wherein at least one resistor is a ballast resistor.

4. The method of claim 1, wherein at least one resistor has a resistance of at least 100 mega-ohms but less than 2 giga-ohms.

5. The method of claim 1, wherein at least one resistor has a breakdown voltage of at least 10 kilo-volts, but less than 30 kilo-volts.

6. The method of claim 1, wherein at least one resistor setting is selected to a create uniform corona ion current.

7. The method of claim 1, wherein, the number of resistors equals the number of corona electrodes.

8. The method of claim 1, wherein said aerodynamic force is generated by an aerodynamic fan.

9. The method of claim 1, wherein said aerodynamic force is generated by an aerodynamic blower.

10. The method of claim 1, wherein said aerodynamic force is generated by an aerodynamic pump.

11. An apparatus for achieving uniform particulate depositions onto surfaces, comprising:

a deposition surface capable of (1) conducting an ion current; and (2) drawing units of particulate matter to said deposition surface;

a tube;

an array of one or more corona electrodes spatially configured relative to said deposition surface such that a uniform electric field is generated and wherein said array of corona electrodes is capable of (1) creating an corona ion current; (2) creating a particulate charging zone having an ion charge density in the range of 0.001-0.01 Coulombs/meter$^3$; (3) charging greater than or equal to 99.5% of all units of particulate matter passing through said charging zone; (4) charging each unit of said 99.5% of all units of particulate matter to its saturation level in 500 microseconds or less; and (5) producing a spatially uniform charge density that reduces the negative effects of any corona wind generated; said corona electrodes being fixed to said tube;

one or more resistors associated with said corona electrodes and capable of being selectively set to one or more possible settings; and a means for creating an aerodynamic force.

12. The apparatus of claim 11, wherein the distances between the corona electrodes is uniform.

13. The apparatus of claim 11, wherein at least one resistor is a ballast resistor.

14. The apparatus of claim 11, wherein at least one resistor has a resistance of at least 100 mega-ohms but less than 2 giga-ohms.

15. The apparatus of claim 11, wherein at least one resistor has a breakdown voltage of at least 10 kilo-volts, but less than 30 kilo-volts.

16. The apparatus of claim 11, wherein at least one resistor setting is selected to a create uniform corona ion current.

17. The apparatus of claim 11, wherein, the number of resistors equals the number of corona electrodes.

18. The apparatus of claim 11, wherein said means for creating an aerodynamic force is an aerodynamic fan.

19. The apparatus of claim 11, wherein said means for creating an aerodynamic force is an aerodynamic blower.

20. The apparatus of claim 11, wherein said means for creating an aerodynamic force is an aerodynamic pump.

* * * * *